US006126134A

United States Patent [19]

Adkins

[11] Patent Number: 6,126,134

[45] Date of Patent: Oct. 3, 2000

[54] COLLAPSIBLE SHEET SUPPORT APPARATUS

[76] Inventor: Edward D. Adkins, 4622 Skyline Dr., Rockford, Ill. 61107

[21] Appl. No.: 09/160,226

[22] Filed: Sep. 24, 1998

[51] Int. Cl.[7] ..... A47B 97/04

[52] U.S. Cl. ..... 248/460; 248/178.1; 248/462; 108/10; 108/140; 403/83; 403/102

[58] Field of Search ..... 248/460, 462, 248/178.1; 108/6, 10, 152, 140; 403/83, 84, 102

[56] References Cited

U.S. PATENT DOCUMENTS

| | | | |
|---|---|---|---|
| 329,593 | 11/1885 | Pfleghar | 248/462 |
| 576,327 | 2/1897 | Rockwell | 248/462 |
| 850,998 | 4/1907 | Daly et al. | 248/462 |
| 1,862,411 | 6/1932 | Mackenzie, Jr. | 403/102 |
| 2,046,134 | 6/1936 | Ryang | 248/462 |
| 2,079,072 | 5/1937 | Kluson | 248/462 |
| 3,923,047 | 12/1975 | Chant | 128/80 F |
| 4,213,591 | 7/1980 | Jaakkola | 248/281.1 |
| 4,726,556 | 2/1988 | Weir | 248/460 |
| 5,242,145 | 9/1993 | Wang | 5/99.1 |

FOREIGN PATENT DOCUMENTS

| | | | |
|---|---|---|---|
| 457459 | 5/1913 | France | 248/460 |
| 141212 | 5/1903 | Germany | 248/460 |
| 57313 | 8/1911 | Switzerland | 248/460 |

*Primary Examiner*—Ramon O. Ramirez
*Assistant Examiner*—Walter Landry
*Attorney, Agent, or Firm*—Kajane McManus

[57] ABSTRACT

The collapsible sheet support apparatus comprises a horizontal center beam to which a plurality of arms, which are pivotable relative to the center beam, are engaged. At least one pair of bottom arms creates legs for supporting the center beam. At least a further pair of top arms may be engaged to the center beam to allow engagement of a sheet larger than can be accommodated by the center beam to the apparatus.

20 Claims, 3 Drawing Sheets

COLLAPSIBLE SHEET SUPPORT APPARATUS

BACKGROUND OF THE INVENTION

The present invention relates to a sheet support apparatus. More particularly, the support apparatus comprises a plurality of linked elongate members which are moveable relative to each other, being folded together, or collapsed, for storage and/or transport and being extended to any of a plurality of possible relative positions to accommodate engagement thereto of a sheet of material, such as paper, for maintaining such sheet in an orientation for ease in viewing same.

PRIOR ART

Heretofore, various types of support apparatus such as easels, tables, boards, etc. have been proposed for supporting a document, such as a print, drawing, typed page, etc., in position for ease in viewing of same.

Such apparatus have heretofore not provided for accommodation of various sized documents, from a photograph up to a large scale blue print, while providing collapsibility for ease in storing and/or transport of such apparatus.

SUMMARY OF THE INVENTION

Accordingly it is a primary object of the invention to provide a collapsible sheet support apparatus which is easily stored and transported, and which will accommodate various sized sheets engaged thereto in an orientation providing easy viewing thereof.

This object, as well as others is met by the support apparatus of the present invention which comprises at least a horizontally disposed elongate planar center beam and two bottom arms attached to the beam and pivotably extending downwardly of the beam in parallel alignment relative to each other and in perpendicular alignment relative to said center beam.

DESCRIPTION OF THE PREFERRED EMBODIMENT

Figure 1:
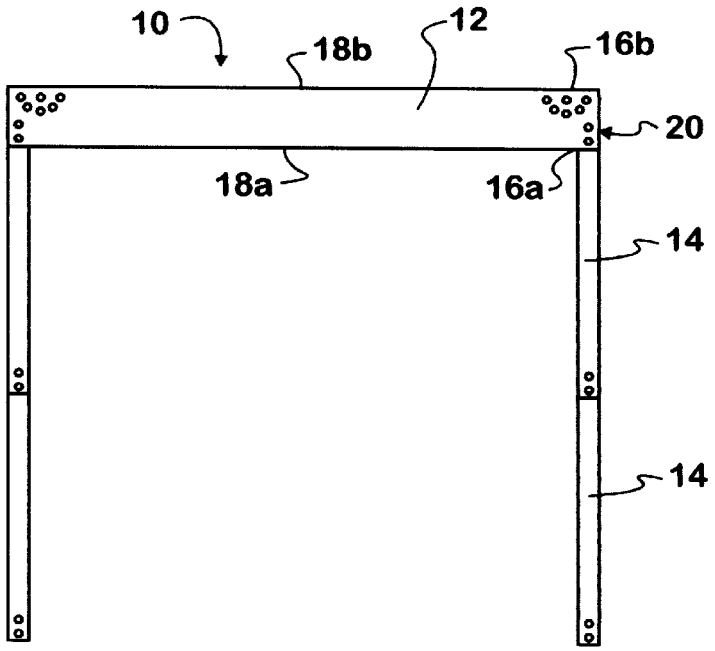
FIG. 1 is a front perspective view of the support apparatus of the present invention in an elemental form thereof.

Referring now to the drawings in greater detail, there is illustrated therein a collapsible sheet support apparatus made in accordance with the teachings of the present invention and generally identified by the reference numeral 10.

As shown, the apparatus 10 comprises, in its most elemental form, a horizontal center beam 12 to which a plurality of interconnectable extendible arms 14 may be suitably engaged.

Figure 3:
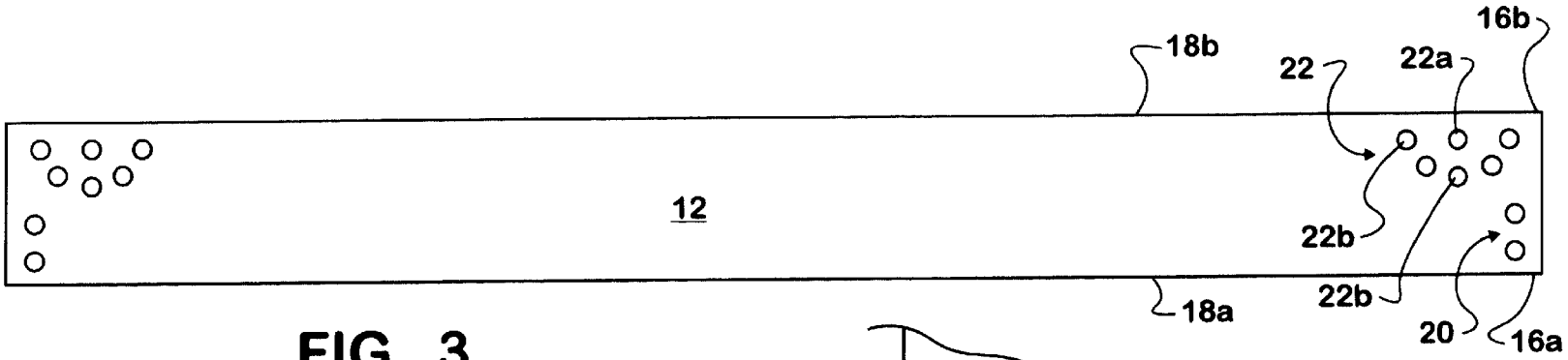
FIG. 3 is an enlarged view of a center beam of the apparatus.

The center beam 12, as best illustrated in FIG. 3, is a rectangular, planar member having two pairs of corners 16*a* and 16*b*, and two elongate edges 18*a* and 18*b*. Each bottom corner 16*a*, defined in part by bottom edge 18*a*, includes a pair of linearly aligned bores 20 therein, the line along which the bores 20 lie extending perpendicularly from the edge 18*a* toward the 18*b*.

In contrast, in each top corner 16*b*, defined in part by top edge 18*b*, there is provided a plurality of bores 22 having an arrangement wherein one of the bores, 22*a*, serves as a center point bore 22*a* about which a desired plurality of bores 22*b* are disposed, in a radial array, with the bores 22*b* being spaced from the bore 22*a* a distance equal to the spacing between the bores 20.

Turning now to a study of the extendible arms 14, it will first be understood that all arms 14 are identical, each arm 14 being of an elongate, planar configuration having two ends 24 and 26.

The end 24 includes a pair of linearly aligned bores 28 therein which are spaced apart a distance identical to that between the linearly aligned bores 20 in the center beam 12.

The opposite end 26 includes a detent 32 thereon, in the form of an end nub 32, which is linearly aligned with and spaced from a bore 34, a distance equal to the distance between the bores 20.

All end structures 28, 32, and 34 of the arm 14 are aligned along a center line extending end to end (24 to 26) along a length of the arm 14.

Figure 7:
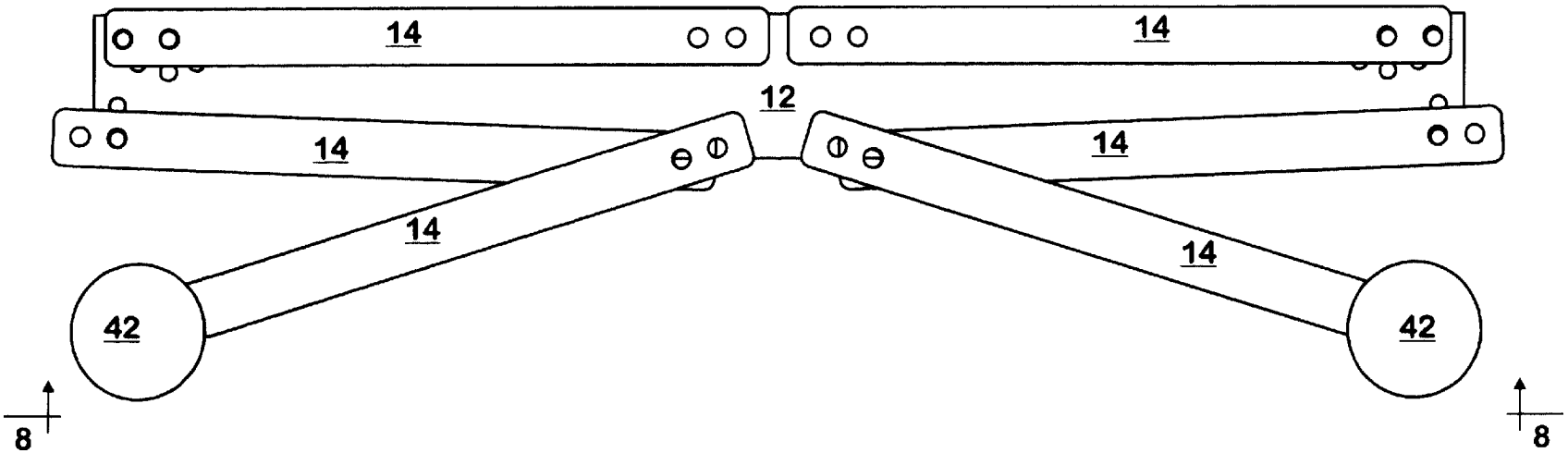
FIG. 7 is a perspective view of the apparatus of FIG. 2 showing same being collapsed for storage or transport.
Figure 8:
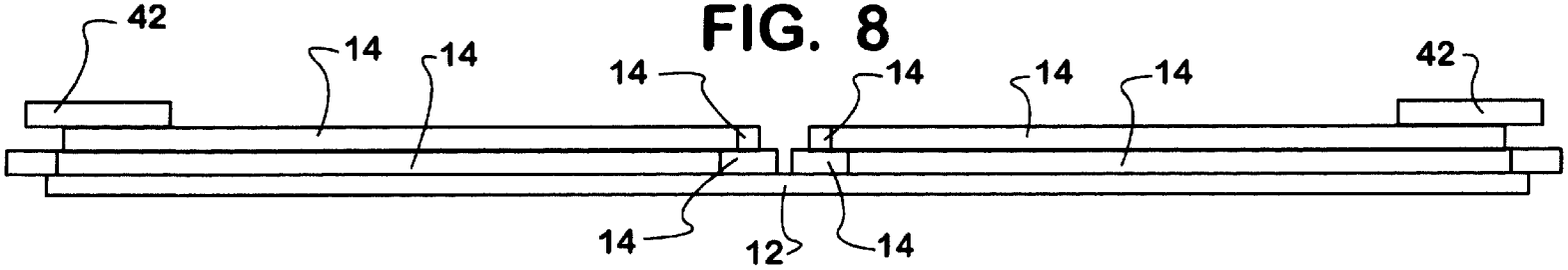
FIG. 8 is a side view of the collapsed apparatus and is taken along lines 8—8 of FIG. 7.

The particular configuration of the arm ends 24 and 26 is necessary for pivotable engagement of the arms 14 to the center beam 12, as well as to each other, in a manner where relative positioning between the structures can be releasably latched in place and wherein the arms 14 can be pivoted into a transport or storage, collapsed position lying over the center beam 12, as best illustrated in FIGS. 7 and 8, to create a compact apparatus 10. It must also be stated here that all bores 20, 22, 28, and 34 are the same size.

Figure 6:
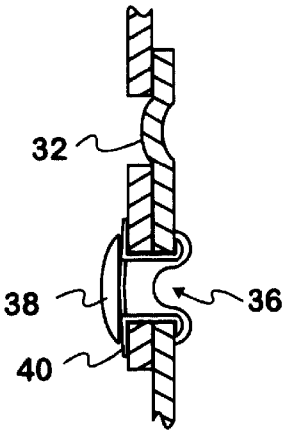
FIG. 6 is a cross sectional view through the area of engagement of FIG. 5.
Figure 5:
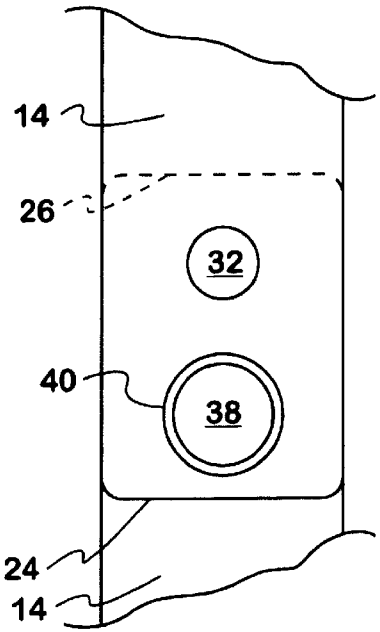
FIG. 5 is an enlarged view of an area of engagement between structures of the apparatus.
Figure 4:
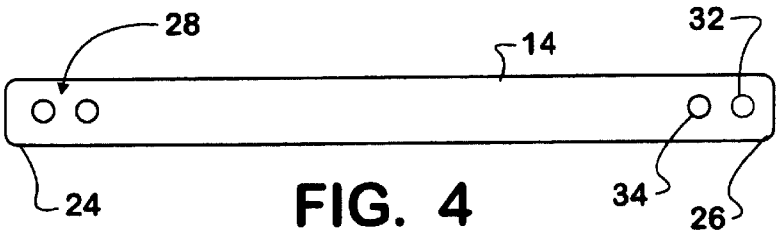
FIG. 4 is an enlarged view of an arm of the apparatus.

As best illustrated in an elemental form in FIG. 1, the center beam 12 is engaged to each of at least two arms 14, in the manner shown in FIGS. 5 and 6, wherein the detent 32 of the arm 14 is engaged in an upper one of the two bores 20 in each bottom corner 16*a* of the center beam 12, with a suitable connector 36 being engaged through a lower one of the bores 20 in the bottom corner 16*a*, and through the bore 34 in the arm 14 aligned therewith, producing a pivot point about which the arm 14 can be pivoted relative to the center beam 12.

It will be understood that engagement between two arms 14 is formed in the same manner, with the end 24 of one arm 14 engaging the end 26 of another arm 14.

It will further be understood that there must be a certain amount of play in the engagement, allowing for disengagement of the detent 32 from within the corresponding bore 20 in the center beam 12 or from within the corresponding bore 28 of an arm 14 so that the structures are pivotable relative to one another.

In the preferred embodiment shown, the connector 36 comprises a hollow rivet 36 having a head 38 of a diameter larger than that of the bore 20, with a compressible ring member 38 such as an elastomeric washer 40 being interposed between the head 38 of the rivet 36 and the structure (arm 14 or beam 12) immediately adjacent thereto, with a free end 42 of the rivet 36 locking the structures together. Although a rivet 36 is shown, this is not to be construed as limiting.

The necessity for a certain degree of play in the area of engagement becomes most obvious when the engagement between an arm 14 and a top corner 16*b* of the beam 12 is considered.

Here, it will be understood that the connector 36 engages through center point bore 22*a* in the beam 12 and bore 34 in the arm 14. Thus, because of the radial array of bores 22*b* provided in the beam 12, the detent 32 of the arm 14 may be engaged in any bore 22*b* to position the opposite end 24 of the arm 14 at a desired orientation for accommodating a sheet having a greater extent than that of the apparatus of FIG. 1.

Figure 2:
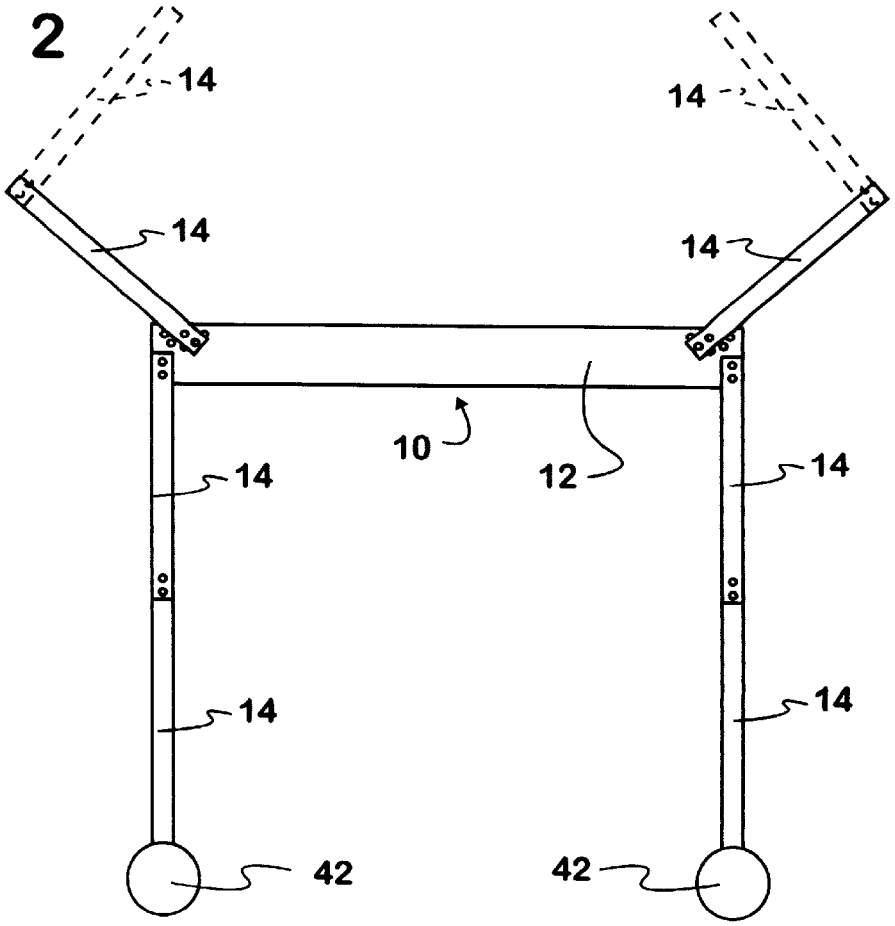
FIG. 2 is a perspective view of the apparatus of FIG. 1 showing same incorporating structure for engaging a sheet larger than the apparatus of FIG. 1 and structure for releasably engaging the apparatus to a metal supporting surface.

Further, it may be necessary at times to engage a plurality of linked together arms 14 to each top corner 16*b*, as illustrated in phantom in FIG. 2 so the number of arms 14 which can be linked together is only limited by the size of the sheet to be engaged by the apparatus 10.

The same limitation holds true for the arms 14 engaged to either bottom corner 16*a*.

Further, as illustrated in FIG. 2, for portability, it is proposed to engage a large magnet 42 to a free end of each terminal arm 14 engaged to a bottom corner 16*a* by suitable means, such as a threaded connector (not shown), extending through the magnet 42 and a bore 28 of the arm 14 for engagement to a vertical metal supporting surface (not shown).

However, if it is desired to mount the apparatus 10 permanently, one could do so by engaging a suitable connector (not shown) through the bores 28, and directly into a vertically oriented supporting structure (not shown).

Inasmuch as the apparatus 10 is of a substantially planar configuration, it will be understood that a sheet to be supported thereby may be attached to the structures by any suitable means, such as tape, paper clips, clamps, etc. Further, if a layer of magnetizable material were incorporated into the center beam 12 and arms 14, even small magnets could be used to sandwich the sheet against the apparatus 10.

As described above, the collapsible sheet support apparatus 10 provides a number of advantages, some of which have been described above and other of which are inherent in the invention. Also, modifications may be proposed to the collapsible sheet support apparatus 10 without departing from the teachings herein. Accordingly, the scope of the invention is only to be limited as necessitated by the accompanying claims.

I claim:

1. A collapsible sheet support apparatus which is adapted to engage a vertical supporting surface comprising at least a horizontally disposed elongate planar center beam and at least two of a plurality of interengageable arms pivotally attached to the beam and extending downwardly from the beam in parallel alignment relative to each other and being perpendicular to said elongate beam, each of said two arm including structure releasably engaged thereto for firmly and releasably engaging said apparatus to said vertical supporting surface, said apparatus further including at least two more of the plurality of arms extending upwardly from said center beam and being pivotably engaged to said beam to be positionable at one of a plurality of predefined angles relative thereto, thereby enabling said apparatus to hold various sized sheets of material in place against said surface when said apparatus is firmly engaged to said surface.

2. The apparatus of claim 1 wherein all arms are identical.

3. The apparatus of claim 2 wherein said center beam is in the form of an elongate planar rectangle having four corners and elongate top and bottom edges.

4. The apparatus of claim 3 wherein said are identical arms are identical comprise elongate planar rectangles, each having a first end and a second end.

5. The apparatus of claim 4 wherein said center beam has a pair of bottom corners defined in part by said bottom edge.

6. The apparatus of claim 5 wherein said center beam has a second pair of top corners defined in part by said top edge.

7. The apparatus of claim 6 wherein a pair of bores which are spaced apart a predetermined distance are linearly aligned in each of said bottom corners along a line extending from said bottom edge to said top edge.

8. The apparatus of claim 7 wherein a plurality of bores are provided in each of said top pair of corners.

9. The apparatus of claim 8 wherein said bores are oriented to provide a center bore adjacent the top edge about which a plurality of bores are radially arranged at a predetermined distance from said center bore.

10. The apparatus of claim 9 wherein the first end of each arm has a pair of centered linearly aligned bores therein spaced a predetermined distance apart.

11. The apparatus of claim 10 wherein the second end of each arm includes an end tab defining a detent which is linearly aligned with and spaced a predetermined distance from a bore provided in said second end.

12. The apparatus of claim 7 wherein all predetermined distances are the same.

13. The apparatus of claim 11 wherein the first end of one arm engages the second end of another arm.

14. The apparatus of claim 13 wherein one arm is engaged to each corner of said center beam by the second end of the arm.

15. The apparatus of claim 14 wherein the detent of the second end of the arm engages within an upper bore of the linearly aligned bores in the center beam and a bottom bore of the linearly aligned bores in the center beam aligns with the bore in the second end of the arm.

16. The apparatus of claim 15 wherein a rivet extends through the bottom bore of the linearly aligned bores in the center beam and the aligned bore in the second end of the arm to engage the arm to the center beam.

17. The apparatus of claim 16 wherein the rivet has a head larger than the bore and wherein an elastomeric ring engages about the rivet adjacent the head thereof.

18. The apparatus of claim 17 wherein the detent engages within one of the radially arrayed bores in a top corner of the center beam and the bore in the second end of the arm aligns with the center point bore in the top corner.

19. The apparatus of claim 18 wherein a rivet extends through the centerpoint bore in the top corner of the center beam and the aligned bore in the second end of the arm to engage the arm to the center beam.

20. The apparatus of claim 19 wherein the rivet has a head larger than the bore and wherein an elastomeric ring engages about the rivet adjacent the head thereof.

* * * * *